US005718260A

United States Patent [19]

Leonardi

[11] Patent Number: 5,718,260

[45] Date of Patent: Feb. 17, 1998

[54] FUEL TRANSFER APPARATUS

[76] Inventor: Anthony Leonardi, 601 SE. 26th Ave., Fort Lauderdale, Fla. 33301

[21] Appl. No.: 521,877

[22] Filed: Aug. 23, 1995

[51] Int. Cl.[6] ..... F17D 1/08; B67D 5/04

[52] U.S. Cl. ..... 137/355.16; 137/572; 137/614.04; 141/388

[58] Field of Search ..... 137/355.16, 572, 137/614.04; 141/388, 389

[56] References Cited

U.S. PATENT DOCUMENTS

| | | | |
|---|---|---|---|
| 2,375,834 | 5/1945 | Walker | 137/572 X |
| 3,170,495 | 2/1965 | Wagner | 137/572 X |
| 3,272,241 | 9/1966 | Wagner | 141/388 |
| 3,409,040 | 11/1968 | Weston et al. | 137/572 |

OTHER PUBLICATIONS

Catalog QC-590-1, Apr., 1993 4 pages Swagelok Quick--Connect Co. Hudson, OH.

*Primary Examiner*—John Rivell
*Attorney, Agent, or Firm*—Alvin S. Blum

[57] ABSTRACT

Apparatus transfers fuel from the pressurized fuel line of a fuel-using motor vehicle to another vehicle or fuel container through a flexible hose. A T connector or Y connector is installed in the fuel line. The branch is supplied with a shut off valve and a double end shut-off quick connect coupling to a flexible hose with a valved nozzle at its end. When the hose is detached for storage, the coupling upon opening automatically seals both free ends to prevent leakage in the engine compartment while the shut off valve provides extra security. A unique venting system for the detached hose is also provided.

1 Claim, 2 Drawing Sheets

FUEL TRANSFER APPARATUS

BACKGROUND OF THE INVENTION

This invention relates to fuel transfer, and more particularly to apparatus for transfering fuel from one motor vehicle to the tank of another vehicle or to a fuel container.

There are many situations where a vehicle with fuel in the tank is accessible to a vehicle or other fuel driven device that is devoid of fuel. The usual remedy is to drive the operating vehicle to a filling station and return with a container of fuel. In other cases a hose is used to siphon fuel from the tank. Some vehicles have devices in their fuel system to prevent the theft of fuel. Siphoning is awkward and may result in ingesting some of the fuel.

SUMMARY OF THE INVENTION

It is accordingly an object of the invention to provide apparatus that is safe, convenient and easily controlled for removing fuel from a motor vehicle that uses the engine operating mechanisms to force the fuel from the tank, through a flexible hose to a container. The apparatus includes a T connector that is interposed in the vehicle's pressured fuel line. The branch from the T connector has a shut-off valve so that in normal operation there is no change in the fuel system of the vehicle. In series with the shut-off valve is a quick-connect coupling to a flexible fuel hose which terminates in a nozzle with a spring loaded cut-off valve. In normal vehicle operation the coupling is disconnected and the hose is stored away from the engine. The T-connector branch is closed off by two valves, the shut-off valve and the quick-connect coupling. When fuel needs to be dispensed from the vehicle, the coupling is joined, the shut-off valve is opened, the engine is started, and fuel under pressure is available at the nozzle by operating the cut-off valve. The process is reversed when the dispensing is completed. This will be convenient and useful for diesel engines on the farm or construction sites, for fueling garden equipment, and for highway patrol vehicles to assist stranded motorists, for example.

These and other objects, features and advantages will become more apparent when the detailed description is considered in conjunction with the drawings.

DETAILED DESCRIPTION OF PREFERRED EMBODIMENT

Figure 1:
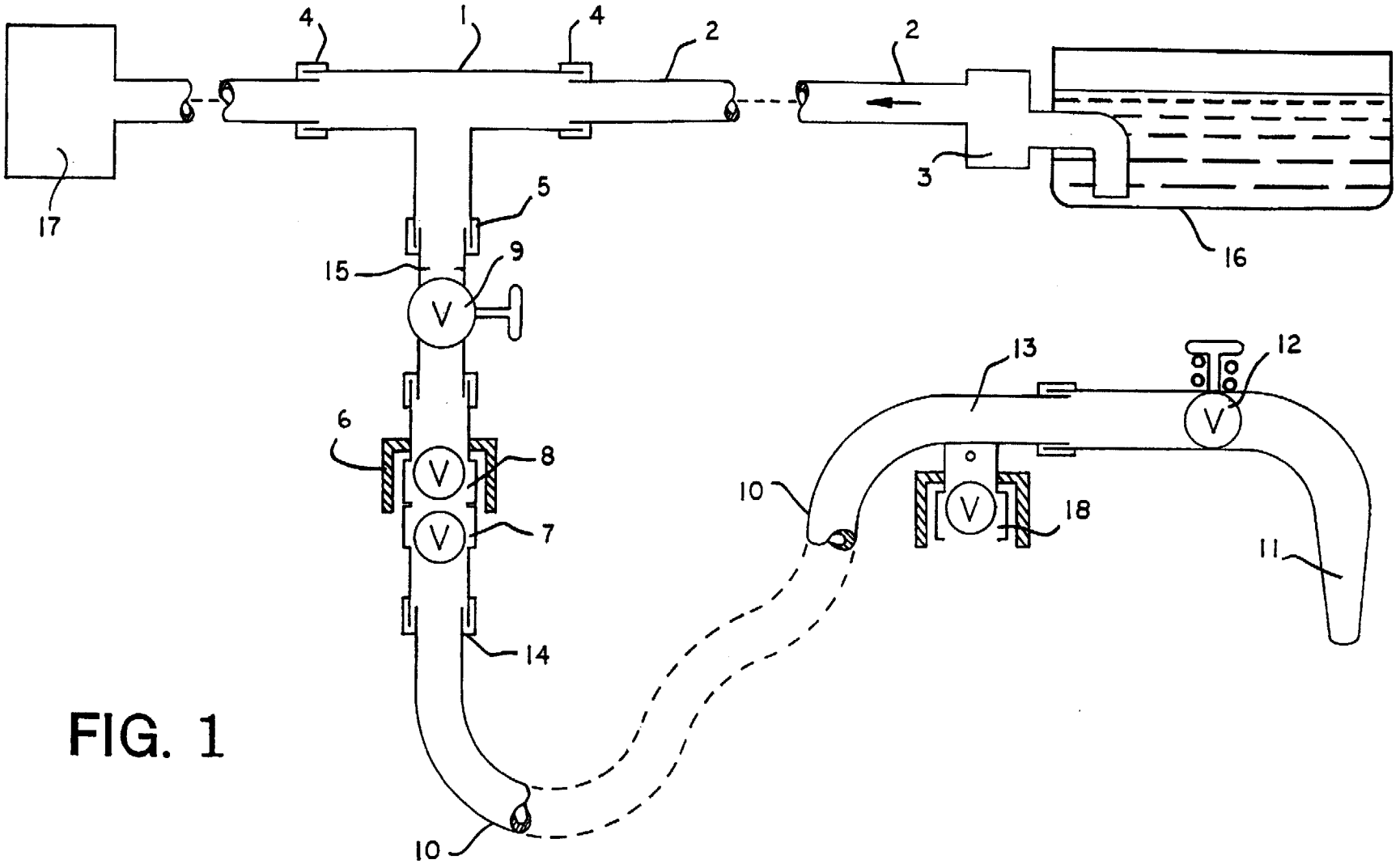
FIG. 1 is a schematic illustration of the apparatus of the invention in use.

Referring now to the drawings, a fuel line 2 in a conventional fuel-using vehicle leads from a fuel pump 3 to force fuel under pressure from the fuel tank 16 to the engine's carburetor, fuel injectors or the like at 17. A three-end connector 1 such as a T-connector or a Y-connector well known in the art is interposed in in the fuel line. The fuel line 2 is cut and two ends 4 are sealingly connected to the cut line such as by ferrule fittings or flange fittings. The third end 5 of the connector 1 is sealed to a shut off valve 9, the second end of which is connected to a double end shut-off quick connect coupling 6 which is in fluid connection with flexible hose 10 at a hose end terminus 14.

Flexible hose 10 terminates at its free end 13 in a nozzle 11 provided with a spring-loaded, normally-off cut-off valve 12. When connected as shown in FIG. 1, valve 9 may be opened, the engine started to operate the fuel pump 3 and pressurize line 2 with fuel. Fuel under pressure will then be available at nozzle 11 whenever valve 12 is actuated at the nozzle for filling fuel containers or the tank of another vehicle. A restrictive orifice 15 may be installed anywhere in the circuit branching from the fuel line to limit flow.

Figure 2:
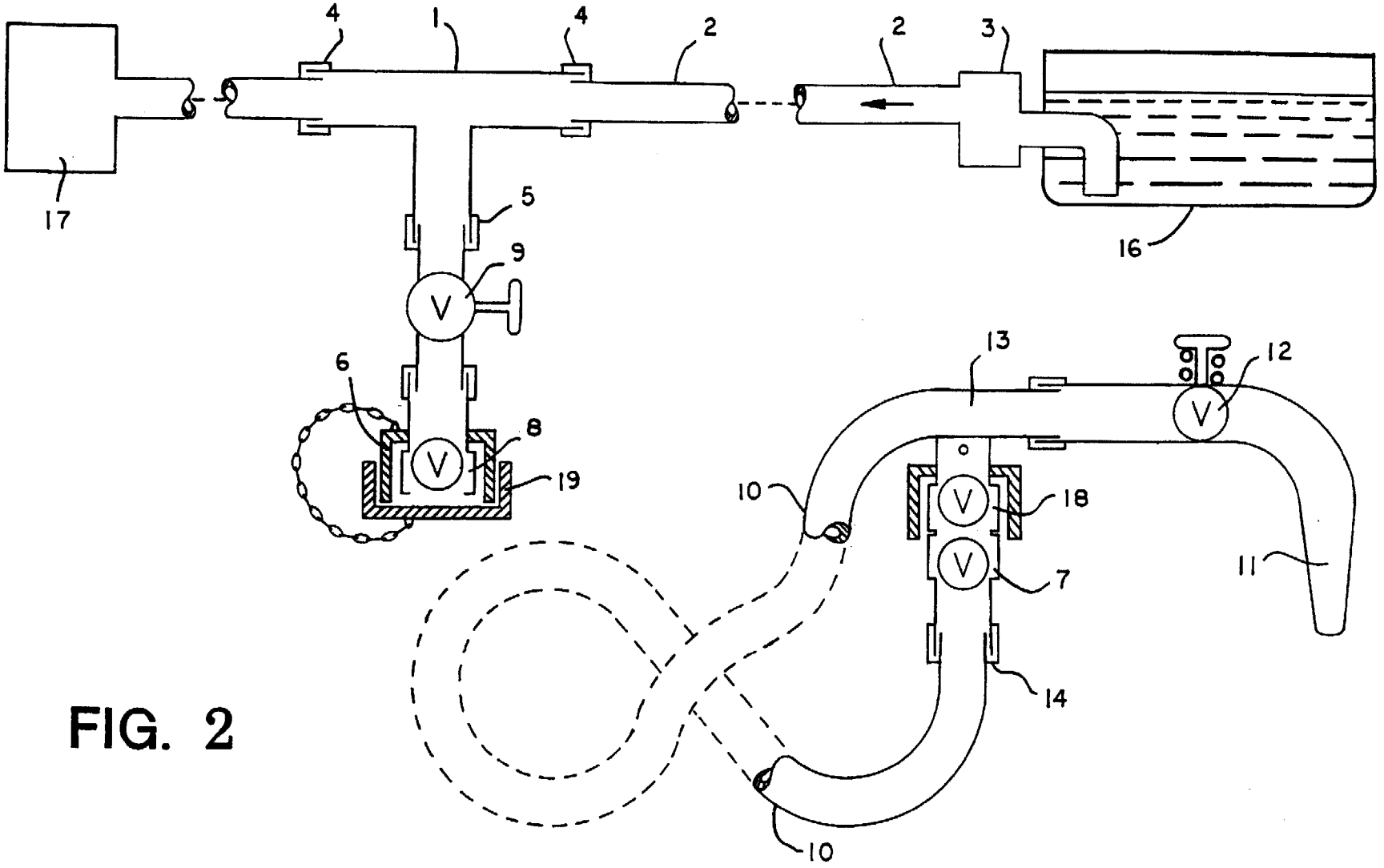
FIG. 2 is a schematic illustration as in FIG. 1 with hose disconnected.

Several safety elements are incorporated in the apparatus to prevent spilling of fuel in the engine compartment. The double end shut-off quick connect coupling 6 is exemplified by the SWAGELOK Q C4-D-400 connector by Swagelok Quick-Connect Co., Hudson, Ohio. When uncoupled, as shown in FIG. 2, the two ends of the coupling both automatically seal shut with release of only a few drops of fluid even when uncoupled under pressure. For safety back up, the shut-off valve 9 is provided so that any leakage at the first coupling end 8 of the uncoupled connector is doubly prevented. When uncoupled, the hose will hold fuel sealed between the second coupling end 7 and the cut-off valve 12. To empty the hose through the nozzle, the second coupling end 7 must be vented. This is best accomplished by another first coupling end 18 attached to the hose but in fluid communication with the atmosphere. The coupling end 7 at the free end 14 of the hose is coupled to this end 18, and then operation of the spring loaded shut-off valve 12 allows fuel captive in the hose to drain out the nozzle. This also couples and protects the coupling from trauma and contamination when it is stored away from the engine compartment. A tethered protective cap 19 may be provided to protect the coupling end 8 from trauma and contamination.

The above disclosed invention has a number of particular features which should preferably be employed in combination although each is useful separately without departure from the scope of the invention. While I have shown and described the preferred embodiments of my invention, it will be understood that the invention may be embodied otherwise than as herein specifically illustrated or described, and that certain changes in the form and arrangement of parts and the specific manner of practicing the invention may be made within the underlying idea or principles of the invention within the scope of the appended claims.

I claim:

1. Apparatus for transferring fuel from the pressurizable fuel line of a fuel-using motor vehicle, the apparatus comprising:

a three-end connector having two ends connectable in the fuel line, and a third end, the three ends in fluid communication;

a double end shut-off quick connect coupling connected in fluid communication to said third end;

a shut-off valve interposed between the coupling and the third end;

a flexible hose having a nozzle with cut-off valve at a first terminus and connected to said coupling at a second terminus, whereby said nozzle will deliver fuel when said connector is connected in said fuel line, said shut-off valve is on, said coupling is joined, said cut-off valve is on and said fuel line is pressurized, and in which said coupling has a first coupling end connected to said hose and a second coupling end connected to said third end, and said hose is provided with an additional second coupling end that is not in fluid communication with said hose, said additional second coupling end being connectable to said first coupling end when said hose is uncoupled to serve as a vent for the hose and a protector for the first coupling end.

* * * * *